US008695251B2

(12) United States Patent
Reynolds

(10) Patent No.: US 8,695,251 B2
(45) Date of Patent: Apr. 15, 2014

(54) BULLETIN WITH PERIPHERAL STRENGTHENING, BILLBOARD ASSEMBLY UTILIZING SAME AND METHOD OF FORMING BULLETIN AND MOUNTING TO BILLBOARD STRUCTURE

(75) Inventor: Kevin Michael Reynolds, Loveland, CO (US)

(73) Assignee: Circle Graphics, Inc., Longmount, CO (US)

( * ) Notice: Subject to any disclaimer, the term of this patent is extended or adjusted under 35 U.S.C. 154(b) by 253 days.

(21) Appl. No.: 12/703,737

(22) Filed: Feb. 10, 2010

(65) Prior Publication Data

US 2010/0199535 A1 Aug. 12, 2010

Related U.S. Application Data

(60) Provisional application No. 61/151,509, filed on Feb. 10, 2009, provisional application No. 61/292,855, filed on Jan. 7, 2010.

(51) Int. Cl.
*G09F 17/00* (2006.01)

(52) U.S. Cl.
USPC ..... 40/603; 40/610

(58) Field of Classification Search
USPC ..... 40/603, 610
See application file for complete search history.

(56) References Cited

U.S. PATENT DOCUMENTS

| | | | | | |
|---|---|---|---|---|---|
| 3,979,846 | A * | 9/1976 | Euzarraga | 40/603 |
| 4,279,087 | A * | 7/1981 | Crawford | 40/786 |
| 4,817,319 | A * | 4/1989 | Vitale | 40/610 |
| 4,862,615 | A * | 9/1989 | Hillstrom | 40/603 |
| 5,142,804 | A * | 9/1992 | Hillstrom et al. | 40/603 |
| 6,698,441 | B1 * | 3/2004 | Zheng | 135/126 |
| 6,908,353 | B2 * | 6/2005 | Zheng | 441/131 |
| 6,928,951 | B2 * | 8/2005 | Huang | 116/63 P |
| 7,191,555 | B2 * | 3/2007 | Hughes | 40/603 |
| 7,481,013 | B2 * | 1/2009 | Black | 40/624 |
| 2001/0003878 | A1 * | 6/2001 | Dawkins | 40/603 |
| 2003/0200685 | A1 * | 10/2003 | Gibb | 40/603 |
| 2006/0107574 | A1 * | 5/2006 | Zheng | 40/610 |
| 2007/0056200 | A1 | 3/2007 | Ridless | |
| 2007/0110925 | A1 | 5/2007 | Ridless | |

FOREIGN PATENT DOCUMENTS

| | | | |
|---|---|---|---|
| WO | WO 2007/059410 | A2 | 5/2007 |
| WO | WO 2007/078353 | A2 | 7/2007 |
| WO | WO 2007/092605 | A2 | 8/2007 |

* cited by examiner

*Primary Examiner* — Shin Kim
(74) *Attorney, Agent, or Firm* — Dorsey & Whitney LLP

(57) ABSTRACT

A bulletin for use on a mounting structure. The bulletin includes a sheet having a front surface for receiving an image and a rear surface and an outer periphery for extending around the outer surface. A strengthening strip is secured to one of the front surface and the rear surface along at least a portion of the outer periphery for inhibiting damage to the outer periphery when extending around the outer surface of the mounting structure. A billboard assembly, a method of forming a bulletin, and method of mounting a bulletin on a billboard structure are also provided.

21 Claims, 11 Drawing Sheets

BULLETIN WITH PERIPHERAL STRENGTHENING, BILLBOARD ASSEMBLY UTILIZING SAME AND METHOD OF FORMING BULLETIN AND MOUNTING TO BILLBOARD STRUCTURE

CROSS REFERENCE TO RELATED APPLICATIONS

This application claims priority to U.S. provisional patent application Ser. No. 61/151,509 filed Feb. 10, 2009 and to U.S. provisional application Ser. No. 61/292,855 filed Jan. 7, 2010, the entire content of each of which is incorporated herein by this reference.

FIELD OF THE INVENTION

This invention relates generally to advertising displays and more particularly to bulletins suitable for outdoor advertisements.

BACKGROUND

Large graphic bulletins, flex faces or wraps are used on billboards. Various systems for mounting bulletins to the billboards are available, and many use mechanical fasteners or clamps. In certain mounting systems a bulletin or billboard print is installed onto a front of a billboard structure by wrapping or folding the billboard print over and around the perimeter of the billboard structure and subsequently tensioning the print on the back of the billboard structure to make the print appear smooth and taut across the front face of the billboard structure. Such systems typically include a billboard print or bulletin with a size greater than the size of the billboard, such that the outer edges or a portion of the bulletin can be folded over the outer edges of the billboard structure and be accessible from the back of the billboard structure. The perimeter of the billboard print is folded and attached to itself. The billboard print is often secured by adhesive, such as pressure sensitive adhesive tape, or by sewing or welding so as to create pockets around the periphery on the backside of the billboard. A pole or gripper bar is inserted into each of the pockets. Holes are also cut into the pockets along the length thereof, exposing the inserted pole(s) at locations around the perimeter of the assembly. A narrow webbing material is then attached to the pole, generally by means of a hook, on a first end and to a ratchet attached to the billboard structure on a second end. Tension is applied to the bulletin by means of the ratchet so as to tighten the bulletin on the billboard structure.

The maximum tensile strength of the bulletin material is often determined by the maximum strength of the pockets or the durability of the portion of the sheet extending over the outer edges to the billboard structure. In many current systems, a heavyweight bulletin material is used to avoid tearing of the bulletin at the pockets. This often leads to the use of a bulletin material that is stronger and thus heavier and more costly than is actually needed for the front surface area of the bulletin, which can be nearly 80% or more of the bulletin area. Efforts to use lighter weight material have not been successful because it has been found that such material is prone to tear when pulled taut over the edge of the billboard structure, particularly when placed on older or lower quality billboard structures. As a result, replacement of the bulletin results in significant waste. Moreover, this material is not easy to dispose of and cannot be easily recycled. Such lightweight material may also tear as it is installed or tensioned or as a result of the weight of the gripper bar. What is needed is a lightweight bulletin that does not tear during installation and use.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
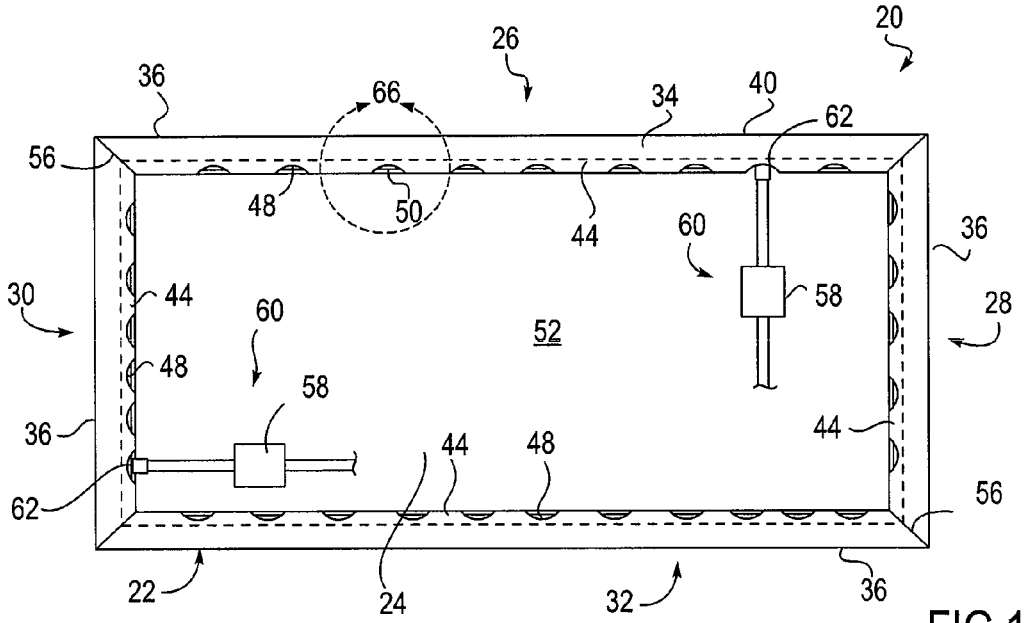
FIG. 1 is a rear elevational view of a billboard assembly having a bulletin with a peripheral strengthening strip of the present invention.

In one embodiment, a bulletin for use on a mounting structure having a face and a backside and an outer surface extending between the face and the backside is provided. The bulletin includes a sheet adapted to extend across the face of the mounting structure and having a front surface for receiving an image and a rear surface and an outer periphery for extending around the outer surface. A strengthening strip is secured to one of the front surface and the rear surface along at least a portion of the outer periphery for inhibiting damage to the outer periphery when extending around the outer surface of the mounting structure.

In another embodiment, a bulletin for use with a pole and on a mounting structure having a face and a backside is provided. The bulletin includes a sheet adapted to extend across the face of the mounting structure and having a front surface for receiving an image and a rear surface and at least one edge. A strengthening strip is secured to one of the front surface and the rear surface along the at least one edge. The strengthening strip at least partially forms a pocket adapted to receive the pole for securing the bulletin to the backside of the mounting structure.

In another embodiment, a billboard assembly is provided that includes a billboard structure having a face and a backside and an outer surface extending between the face and the backside. A sheet having a perimeter and a front surface and a rear surface is included, and at least one strengthening strip is attached to at least a portion of the perimeter on one of the front surface and the rear surface. The sheet is removably mounted to the billboard structure such that the rear surface of the sheet faces the face of the billboard structure and the perimeter of the sheet is folded over the outer surface of the billboard structure such that the strengthening strip extends at least partially over the outer surface for inhibiting damage to the outer periphery of the sheet.

In a further embodiment, a method of forming a bulletin for use with a mounting structure is provided and includes providing a sheet having a perimeter and a display surface and a rear surface and a strip. A portion of the strip is folded over onto itself so as to form a pocket extending along the strip, and the strip is attached to one of the display surface and the rear surface of the sheet along at least a portion of a perimeter of the sheet.

In another embodiment, a method of mounting a bulletin on a billboard structure having an outer surface and a backside is provided and includes providing a sheet having a perimeter and a display surface and a rear surface and a strip. The strip is attached to one of the display surface and the rear surface of the sheet along at least a portion of a perimeter of the sheet. A pocket extending along at least a portion of the perimeter of the sheet is formed with at least one of the sheet and the strengthening strip. The sheet is removably mounted to the mounting structure by folding the perimeter of the sheet around the outer surface of the mounting structure so as to locate the pocket at the backside of the mounting structure.

A bulletin with peripheral strengthening is described and illustrated herein with respect to one embodiment of the invention. FIG. 1 illustrates the back of a billboard assembly 20 showing an exemplary bulletin or graphic 22 or display of the present invention mounted on a billboard 24 for outdoor display. The billboard assembly 20 may be of any suitable size.

The billboard assembly 20 is generally shown in FIG. 1 to have a rectangular shape including a first side or top 26, a second side or left 28, a third side or right 30, and a fourth side or bottom 32. While sides are specifically delineated for purposes of example, any number of sides and labels therefore may be acceptable for the purposes provided.

Figure 2:
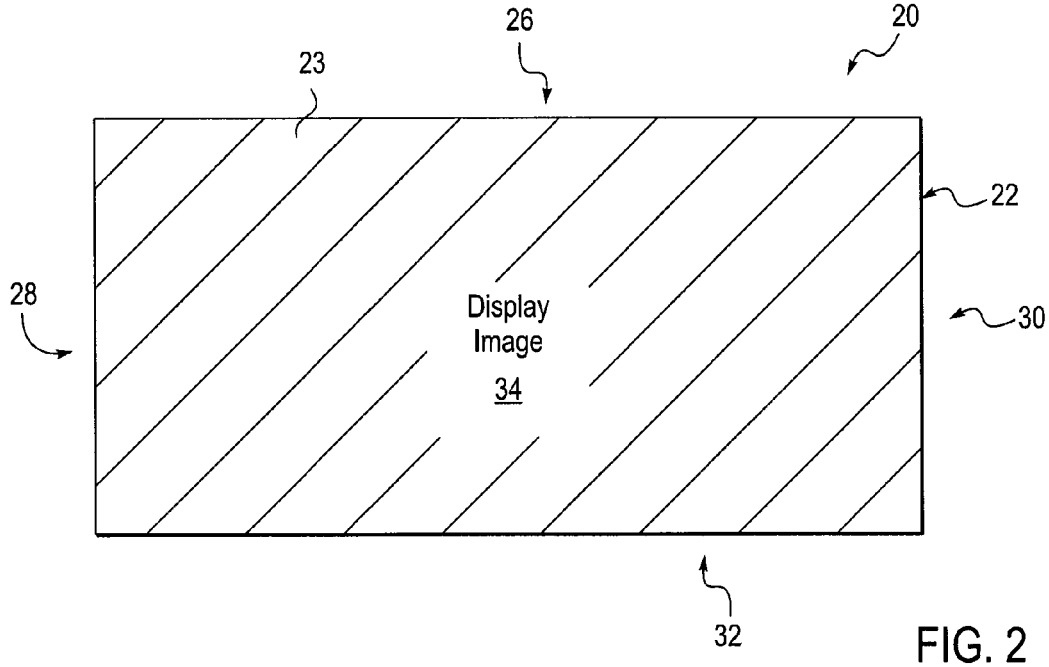
FIG. 2 is a front elevational view of the billboard assembly shown in FIG. 1.
Figure 3:
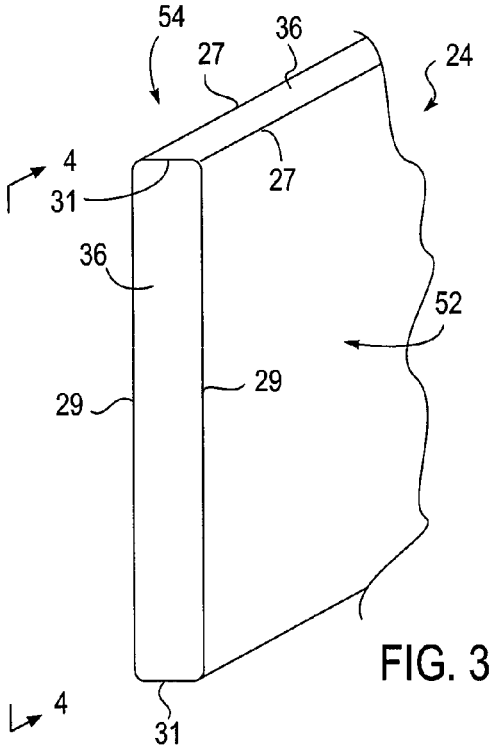
FIG. 3 is a cut away perspective view of a mounting structure for use with the billboard assembly shown in FIG. 1.
Figure 4:
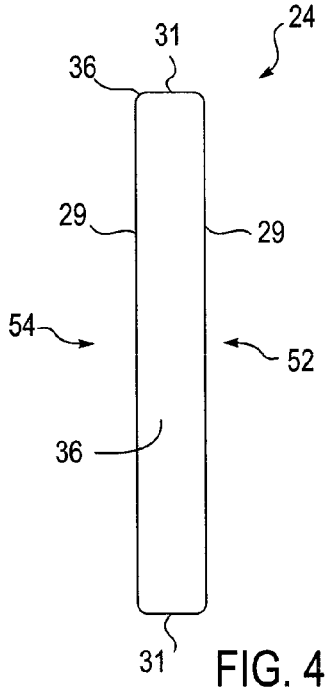
FIG. 4 is an side elevational view of the mounting structure of FIG. 3, taken from line 4-4 of FIG. 3.

The billboard assembly 20 includes a billboard print, flex face, wrap or bulletin 22 that is mounted on a mounting structure, such as a billboard structure 24 or billboard (see FIGS. 1-2). In the illustrated example, the bulletin 22 is mounted to a conventional billboard for use as an outdoor display. The billboard or mounting structure 24 may be formed of any suitable material, such as metal, wood, plastic, combinations thereof or the like, and has a face 54 and a backside 52. The face 54 may have a display surface 34 onto which a bulletin 22 is attached and viewed as shown in FIG. 2. The mounting structure or billboard 24 also has a side surface or outer surface 36 extending between the face 54 and the backside 52 (see FIGS. 3-4). The billboard 24 also preferably has rounded or partially rounded outer edges 27, 29, 31 adjoining surfaces 36 for allowing the smooth movement of a material across the edge of outer surface without tearing or damage. The billboard structure 24 may be any suitable size. As a non-limiting example, the billboard may range from five feet high to twenty feet high, and may range from eleven feet wide to sixty feet wide. In one example of an embodiment, the billboard structure 24 is approximately fourteen feet high by forty-eight feet wide. The side surface 36 may be of any suitable width. In the illustrated example, the side surface 36 has a width which is less than the height or width of the face 54 of the mounting structure, and may be preferably of a width sufficient to provide a degree of rigidity to the mounting structure to withstand forces or stresses placed upon same, such as for example, as may be caused by wind or weight of materials.

The bulletin 22 includes a billboard substrate or sheet 23 that is mounted on the billboard structure 24. The sheet may be generally be a flexible, sheet-like material having a back or rear surface 38 or face and a front surface 40 or face (see generally FIGS. 1-2 and 5-10). More preferably, the sheet 23 is adapted to extend across the face 54 of the mounting structure 24 and has a front surface 40 for receiving an image and a rear surface 38. The sheet 23 also includes at least one edge 41 extending around the entire periphery of the sheet (see FIG. 5). The sheet 23 may be of any suitable size but preferably corresponds in size to the billboard structure 24, and is more preferably slightly larger than the billboard such that a portion of the sheet 23 may be folded over the outer edges or surfaces 36 of the billboard structure 24. In this regard, the sheet has a portion that extends over the side surface 36 of the mounting structure when the sheet is being pulled taut on the mounting structure. To this end, the sheet 23 can be of any suitable size, including sheets that are approximately five (5) feet high by ten (10) feet wide, sheets that are approximately ten (10) feet high by twenty (20) feet wide, sheets that are approximately fourteen (14) feet high by forty-eight (48) feet wide, and sheets that are approximately twenty (20) feet high by sixty (60) feet wide. The sheet 23 is preferably formed of any suitable material acceptable for use as a display. More preferably, the material is a recyclable material and capable of receiving a print or image for display. The sheet 23 is preferably lightweight and can have a weight of less than four (4) oz/yd$^2$. In one embodiment, the sheet 23 has a weight ranging from three (3) oz/yd$^2$ to four (4) oz/yd$^2$. In another embodiment, the sheet has a weight ranging from 0.5 oz/yd$^2$ to three (3) oz/yd$^2$, and in a further embodiment the sheet has a weight ranging from 1.5 oz/yd$^2$ to 2.8 oz/yd$^2$. Examples of materials suitable for use in forming the sheet 23 include plastic. In one embodiment, the sheet 23 is formed from one or more thermoplastics. Suitable thermoplastics include polyvinylchlorides or polyolefins. Suitable polyolefins include polyethylene or polypropylene or combinations thereof.

In one or more examples, the sheet 23 is formed from a layered or laminar structure having a core layer or substrate formed from a flexible, sheet-like material. A first or outer or top layer is bonded, adhered or otherwise secured to the core layer. Optionally, a second or rear or backing layer, which can be similar or identical in composition to the outer layer, may be applied to the core layer opposite the outer layer. The outer layer may be used to provide a printable surface or merely to provide a smooth appearance. Optionally, a printing layer or print receptive coating can be formed on the outside surface of outer layer. The core layer is preferably formed from a strong, flexible, sheet-like material, and cast, extruded, spun bond, non-woven, or woven polymer fabrics may be used for the core layer. The outer layer preferably provides a smooth, opaque, print-receptive surface. The outer layer may be produced by casting, molding, extrusion, film blowing, similar methods or any other suitable means. The thickness of the outer layer is preferably the minimum required to produce a smooth surface, although any suitable thickness can be provided. The outer layer may be joined to the core layer in any suitable manner. For example, the outer layer may be extruded in a fluid state onto the core layer. The outer layer can also be "laminated" to the core layer, that is provided as a sheet, heated, and then pressed onto the core layer. Depending on the characteristics of the core layer, the outer layer and the core layer can be co-extruded simultaneously.

In one or more examples, the sheet material may be a woven polyethylene with a polyethylene extrusion coating on one or two sides of the core layer. However, any suitable material may be used, including a woven or non-woven or spun bond material such as a reinforced polyvinyl chloride, polyethylene having an extrusion coating or top layer coating or other fabric or plastic material.

The display surface 34 of bulletin 22 may be the entire front face 40 of sheet 23 or a substantial portion thereof. Graphics may be disposed on the display surface 34 by any suitable means such as printing. The sheet 23 therefore includes or forms a printing surface. Graphics or images are formed on the surface by any suitable means. In one preferred embodiment, graphics are formed by digital printing techniques, more preferably large scale digital printing techniques and more preferably by large scale digital ink jet printing techniques. In this regard, the composition and structure of the sheet or substrate 23 may have the properties of being printable or print-receptive. In other words, the substrate will receive and hold inks or dyes applied thereto, for example solvent-based inks as used in known inkjet printing process, resistant to creasing, and relatively light weight. The printing surface of sheet 23 may further be substantially opaque, such that printing thereon is clearly readable. For example, a level of opacity of about 95% or greater may be acceptable.

Figure 5:
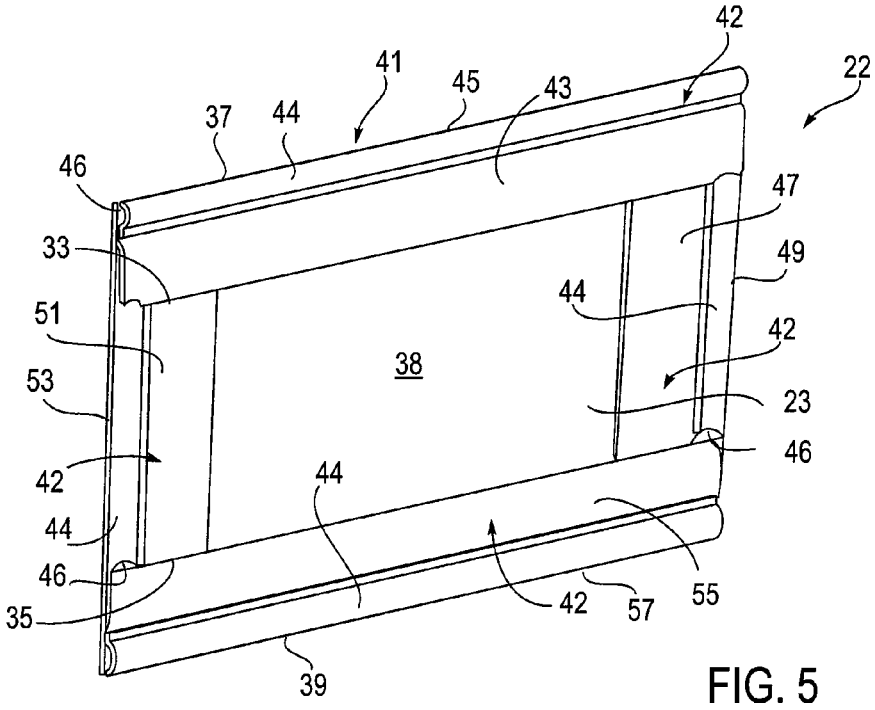
FIG. 5 is a perspective view of the bulletin with peripheral strengthening strip of the billboard assembly shown in FIG. 1.

The bulletin 22 has strengthening strip 42 provided around its outer periphery or perimeter in proximity to the outer edge 41 of the sheet. In FIG. 5, the strengthening strip 42 or perimeter reinforcement is mounted or secured to the rear face or surface 38 of the sheet 23 or a portion thereof. The strengthening strip, however, may be mounted or secured to the front surface 40 of the sheet or a portion thereof. The strengthening strip 42 may be further secured along at least a portion of edge 41 of the sheet 23, such as along longitudinal edge portion 45. Referring to FIGS. 1 and 5-10, one or more strengthening strips 42 are mounted along the outer periphery or edge 41 of the rear of the sheet or billboard substrate. That is, the strip can extend on an edge portion 45, 49, 53, 57 of the sheet and may have one or more ends 33, 35 spaced from an adjacent edge portion of the sheet.

Figure 9:
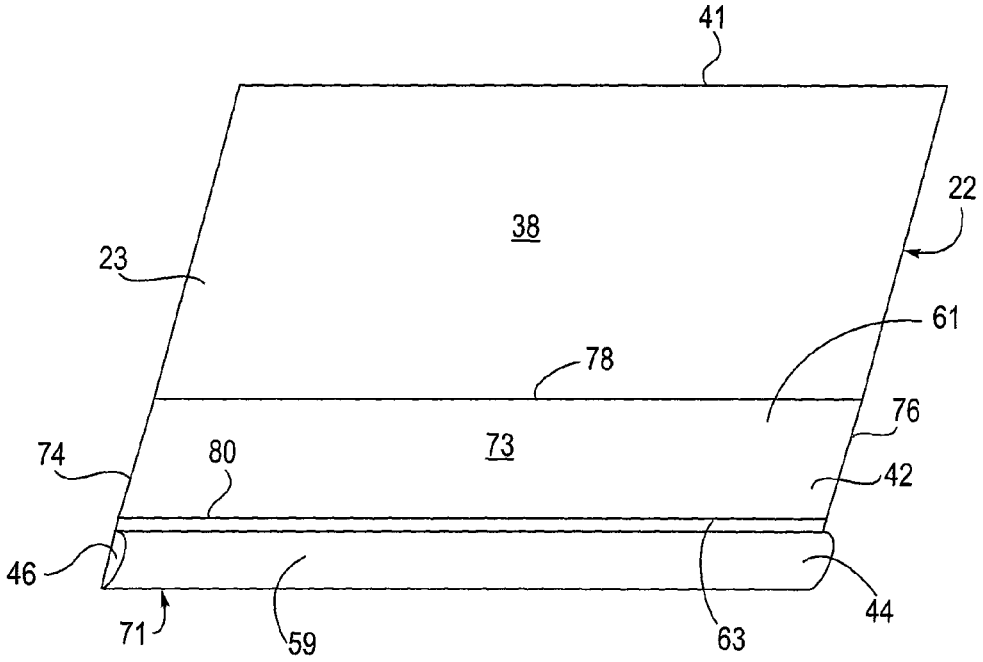
FIG. 9 is a perspective view of a portion of the bulletin with peripheral strengthening strip of the billboard assembly shown in FIG. 1, showing a peripheral strengthening strip along one edge of the rear surface.
Figure 10:
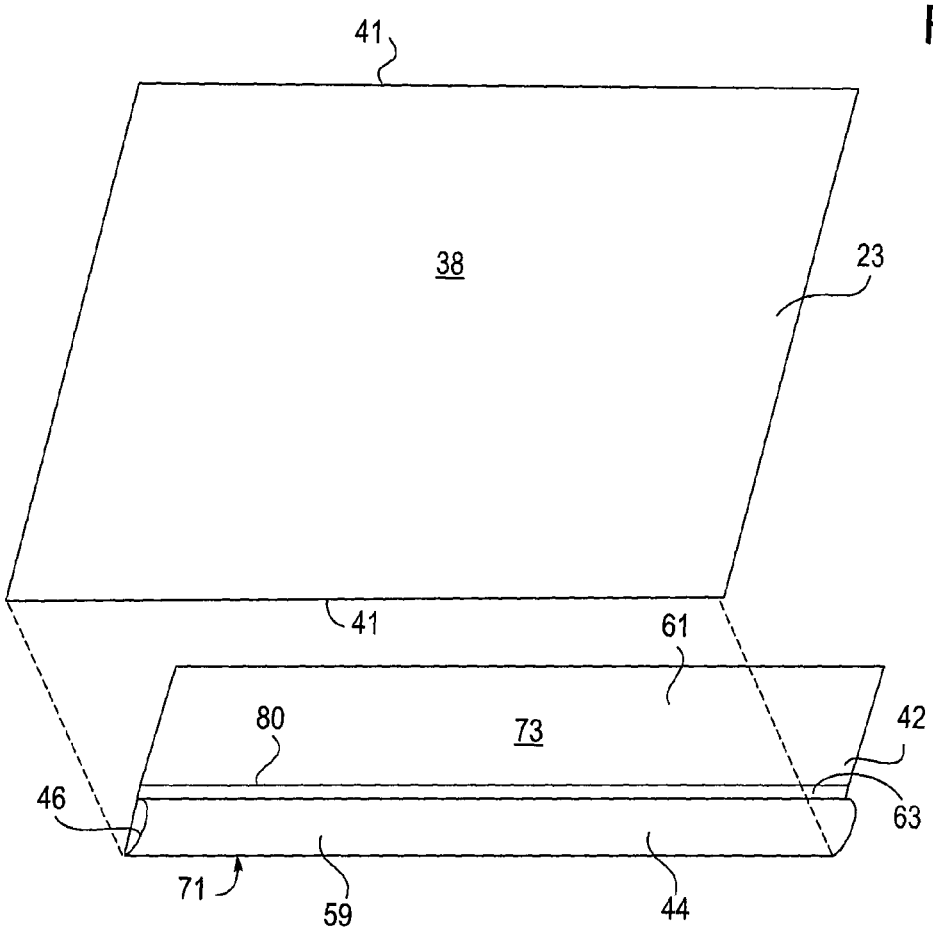
FIG. 10 is an exploded view of the portion of the bulletin with peripheral strengthening strip of FIG. 9.

In one or more examples of embodiments, a plurality of strengthening strips 42 are attached to the sheet 23. In this regard, as shown in FIG. 5, the strengthening strips 42 may be provided on the front surface 40 or rear surface 38 along or around the perimeter or edge of the sheet 23. In FIGS. 5, 9 and 10, the size of strengthening strips 42, also labeled thereon as strips 43, 47, 41 and 55, is exaggerated in relation to the size of the bulletin for purposes of illustration and discussion. The strips may be provided in any suitable length or width, one example of which is provided in FIG. 5. Preferably, the strengthening strip has a width greater than the width of the side or outer surface 36 of the mounting structure 24. A plurality of strengthening strips 42 may be located or provided on the surface. For example, in FIG. 5 a first strengthening strip 43 may be located or attached to the surface 38 along the first edge portion or longitudinal edge portion 45, a second strengthening strip 47 may be located or attached to the surface 38 along the second edge portion or longitudinal edge portion 49, a third strengthening strip 51 may be located or attached to the surface 38 along the third edge portion or longitudinal edge portion 53 and a fourth strengthening strip 55 may be located or attached to the surface 38 along the fourth edge portion or longitudinal edge portion 57. Alternatively, some the strengthening strips can be provided on surface 38 and others provided on surface 40. As a result, a strengthening strip 42 is provided along the edges of the sheet at each of the top 26, bottom 28, left 28, and right 30 sides of the assembly 20 (see FIG. 1). Preferably, the strengthening strip is positioned on a portion of the sheet 23 so as to strengthen such portion when the sheet is mounted on the mounting structure. At the corners 56 of the sheet 23, when wrapped on the backside 52 of the billboard structure 24, as shown in FIG. 1, any suitable arrangement of the sheet with attached strengthening strip may be used. For example, the corners of the sheet 23, and attached strengthening strip 42, may be folded, cut, or simply bunched. Fewer or more than four strengthening strips may be attached to the sheet. In one example, two strengthening strips may be attached along longitudinal edges of the sheet and preferably extend parallel to each other so as to provide tensioning to at least two opposite sides of the sheet 23. For instance, the strengthening strip 42 may be secured to the rear or rear surface 38 of the sheet 23 only along, for example, its two longitudinal edges 37, 39. A plurality of strengthening strips may also be provided along one side or one edge portion of a sheet 23 or bulletin 22.

The strengthening strip 42 may be formed as a separate device from the sheet 23. The strengthening strip 42 may be preferably mounted or secured such that it extends from one to twelve inches deep or in from the outer edge of the sheet 23. In one or more examples of embodiments, the strengthening strip 42 has a length greater than the width of the side surface 36 of the mounting structure 24, and is positioned on the sheet 23 so as to extend across the side surface 36 while the sheet 23 is being pulled taut on and secured to the mounting structure 24 so as to strengthen the portion of the sheet 23 that extends across the side surface 36 of the mounting structure 22 (see FIGS. 6-7). The strengthening strip 42 may be formed of the same material as the sheet 23 material or may be formed of any suitable alternative material. Examples of materials suitable for use in forming the strengthening strip 42 include plastic. In one embodiment, the strengthening strip is formed from one or more thermoplastics. Suitable thermoplastics include polyvinylchlorides or polyolefins. Suitable polyolefins include polyethylene or polypropylene or combinations thereof.

The portion of the sheet 23 having strengthening strip 42 thereon is stronger, more durable or both than the remaining portion of the sheet not having the strengthening strip thereon. This feature can be accomplished by adjusting the weight, tensile strength, puncture or burst strength or any combination of the foregoing of either or both of the material of the sheet 23 and the material of the strengthening strip 42. In one embodiment, the strengthening strip 42 has a weight of at least one (1) oz/yd$^2$. In another embodiment, the strengthening strip has a weight of at least 1.5 oz/yd$^2$. In one embodiment, the strengthening strip 42 may be formed of a material or second material that is stronger than the first material. In this regard, for example, the second material of the strengthening strip 42 can have a weight, tensile strength, puncture or burst strength or combination of such characteristics that is greater than or equal to the corresponding characteristics of the first material or sheet 23 material. For example, the strengthening strip 42 may be formed of a material having a weight ranging from six (6) oz/yd$^2$ to fifteen (15) oz/yd$^2$. Alternatively, the first material of the sheet 23 can have a weight, tensile strength, puncture or burst strength or combination of such characteristics that is greater than the corresponding characteristics of the second material or strengthening strip 42 material.

The construction of the strengthening strip 42, when combined with the sheet 23, permits the bulletin 22, particularly the portion of the bulletin interior of the strengthening strip, to stretch to the point of being flat and smooth.

Figure 6:
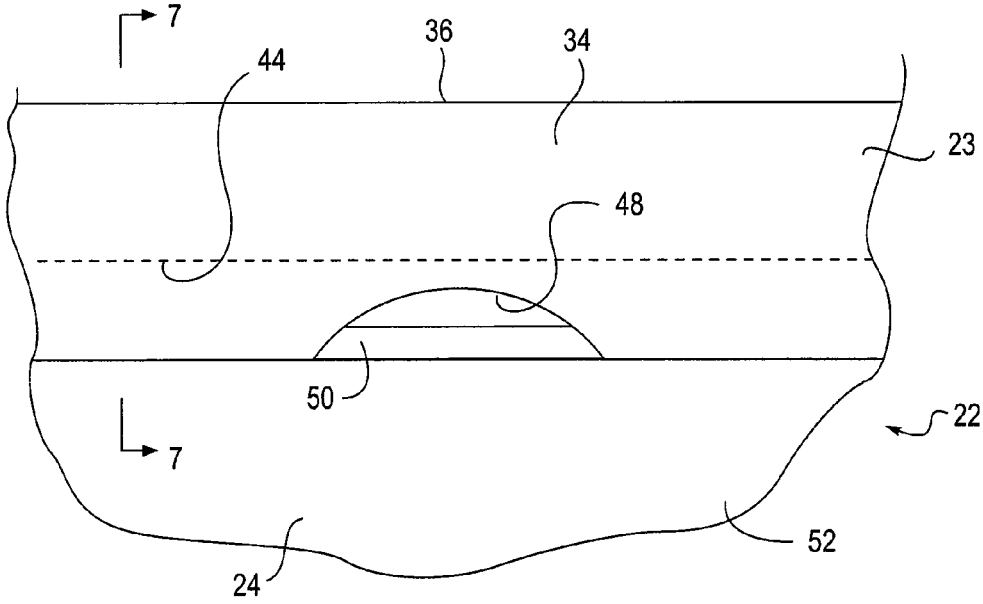
FIG. 6 is an exploded view of a portion of the billboard assembly shown in FIG. 1, taken from the line 6-6 of FIG. 1.
Figure 7:
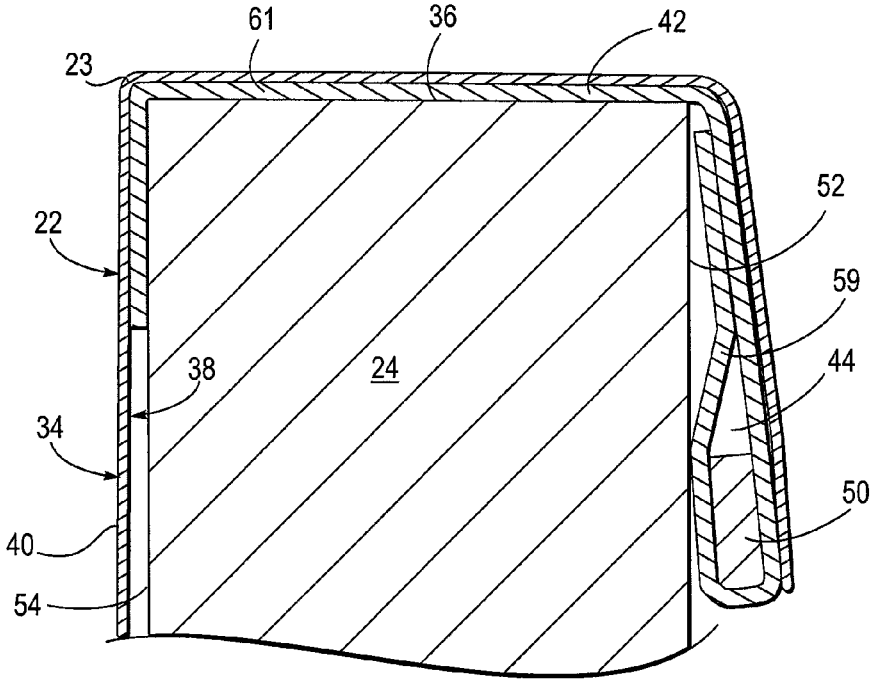
FIG. 7 is a cross-sectional view of the billboard assembly shown in FIG. 1, taken from line 7-7 of FIG. 6.

The bulletin 22 may be for use with a pole 50. More specifically, the sheet 23 and strengthening strip 42 may be adapted to receive a pole 50. In one embodiment, the strengthening strip 42 may be provided with or may form a pocket 44 or pole pocket. The strengthening strip 42 may generally include a folded portion 59 extending longitudinally along the strip for creating the pocket 44. In FIG. 1 the pocket 44 is shown in dashed lines as it is located behind the bulletin material. As can be seen in FIGS. 6-7, pocket 44 through which the pole 50 can extend for securing the bulletin 22 to the backside 52 of the mounting structure 24 is included with or formed from the strengthening strip 42.

Figure 8:
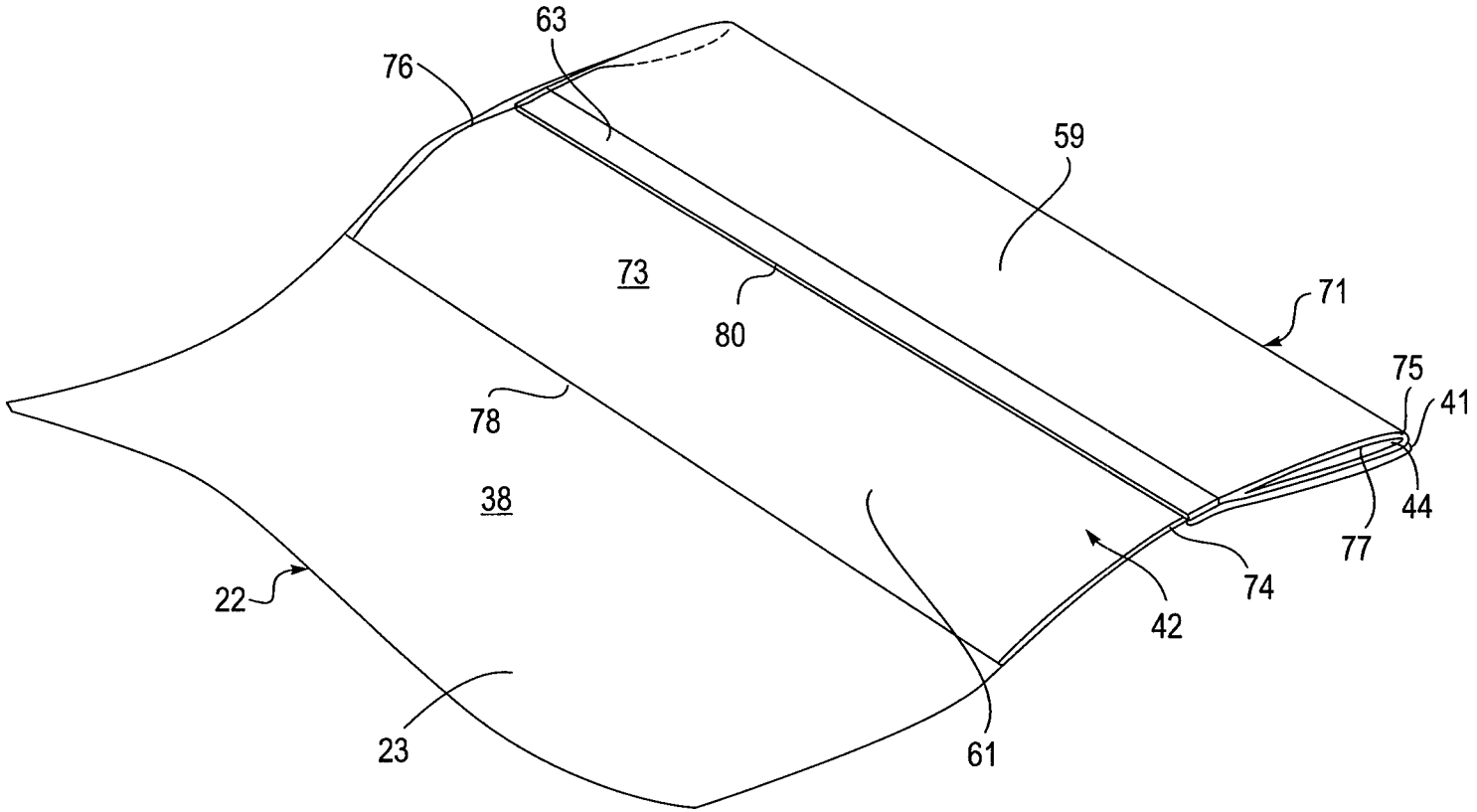
FIG. 8 is a cut away view of a portion of the bulletin with peripheral strengthening strip of the billboard assembly shown in FIG. 1.

For purposes of explanation, FIG. 8 shows only one whole side of a bulletin 22 with strengthening strip 42, the adjoining strips 42 on adjacent edge portions being omitted in the figure. Additional sides of the bulletin 22 and strengthening strips 42 can be equivalent to that shown in FIG. 8. The strengthening strip 42 has a first edge 74 and a second edge 76, as well as a first end 78 and a second end 80. Spanning generally between the first edge and second edge 74, 76 are a first portion 61, a second portion 59 and a third portion 63. The first portion or perimeter reinforcement portion 61 extends from the first end 78 to an imaginary line 71 spaced a distance from the first end 78. In FIG. 8, the imaginary line 71 corresponds to the outer edge 41 of the billboard substrate or sheet 23. The perimeter reinforcement portion 61 may be any suitable width, and more preferably, may be twelve inches. The second portion or folded portion 59 of the strengthening strip 42 overlies a portion of the perimeter reinforcement portion 61 and forms a pole pocket or folded pole pocket 44. The folded portion 59 may be integrally formed with the reinforcement portion 61, that is formed from the same sheet as portion 61 and folding back over a surface 73 of the portion 61 to form a folded edge 75 at the second end or imaginary line 71 of the perimeter reinforcement portion 61. In this regard, the folded portion 59 has a surface 77 which faces surface 73 of the perimeter reinforcement portion 61. The folded portion 59 may be any suitable width, and preferably ranges in length from ⅓ to ¼ of the length of the perimeter reinforcement portion 61, and even more preferably may be approximately four inches in width. An attachment portion 63 or third portion or weld extends between and may be integral with the folded portion 59 and the second end 80 of the strengthening strip 42. The attachment portion 63 is adapted to attach to the perimeter reinforcement portion 61. In this regard, the attachment portion 63 may be provided with a surface (not visible in FIG. 8) which faces and attaches to surface 73 of the perimeter reinforcement portion 61. The attachment portion 63 may be attached along its entire length or width, or along a portion thereof. The attachment portion 63 may be any suitable width and preferably has a width suitable to secure the folded portion in position to form the pole pocket 44. More preferably, the attachment portion 63 may be approximately one inch in width.

The folded portion 59 may face away from the front surface 40 or rear surface 38 of the sheet 23, or alternatively may face the front surface or rear surface. In this regard, the reinforcement portion 61 can be secured to either the front surface 40 or the rear surface 38 of the sheet. The perimeter reinforcement portion 61 may be welded, sewn, adhered or otherwise attached, or partially attached, in any suitable manner to the billboard substrate 23 on a surface, such as the rear surface 38. The strengthening strip 42 may be attached across its entire length or width, or may be attached along a portion thereof, such as along or adjacent to the first edge 74 and second edge 76 or along several longitudinal locations across the width of the strengthening strip 42. For example, first or perimeter reinforcement portion 61 of the strengthening strip 42 can be attached to the substrate 23 along a first longitudinally-extending portion extending adjacent imaginary line 71, so for example adjacent outer edge 41 of the substrate, along a second longitudinally-extending portion in the vicinity or underlying attachment portion 63 and along a third longitudinally-extending portion adjacent first end 78. Alternatively, the third longitudinally-extending portion adjacent first end 78 can be eliminated so that the part of first portion 61 between the second longitudinally-extending portion and first end 78 is not attached to the substrate 23 and is thus a flap that extends free of the substrate 23 In one embodiment, each of such longitudinally-extending portions for securing the portion 61 to the substrate 23 can be one inch wide and in the form of a weld.

The pocket 44 may extend longitudinally along the length of the strengthening strip 42 or the rear surface 38 or front surface 40 of the sheet 23, or may extend along a portion thereof. For example, the pocket 44 may terminate prior to an outer edge of the sheet 23. The folded portion 59 which forms the pocket 44 may be a separate component or integrally formed. The pocket 44 may be a longitudinally extending opening formed by the interior of folded portion 59 that may extend the length of the strengthening strip 42. The pocket may be accessed by an insertion opening 46, or more than one insertion opening 46. For example, an insertion opening 46 may be formed or provided at one or both ends of a folded portion 59 of the strengthening strip 42. The pocket may also have a longitudinally-extending opening along a portion thereof. In one example, the pole pocket 44 is at least partially formed from the strengthening strip 42 which is folded and attached to itself. In this regard, the pocket 44 may be formed entirely from the strengthening strip 42, for example as shown in FIG. 8. The pocket 44 may be any suitable width or length. In an example of one or more embodiments, the pocket 44 and the insertion opening 46 width, as shown in FIGS. 8-9, may range from approximately four inches wide to approximately twelve inches in width.

A plurality of strengthening strips 42 and pockets 44 may be provided. In FIG. 1, a plurality of pockets 44 are provided on the perimeter of the rear surface 38 of the sheet 23 along each side thereof. In FIG. 5, a strengthening strip 42 and pocket 44 are provided on the perimeter of the rear surface 38 of the sheet 23 along each side thereof. Thus, four strips 42 and pockets 44 are provided located adjacent the outer edge 41 of the top, bottom, left and right sides or edge portions 45, 49, 53 and 57 of the sheet 23.

The strengthening strip may be provided with an aperture 48 to access the pocket 44 and the pole 50 in the pocket. More preferably, each pocket 44 may be provided with one or more access holes, openings or apertures 48 spaced along the length thereof (see FIGS. 1 and 6). For purposes of simplicity, openings 48 are not shown in certain figures, such as FIGS. 5, 8-11, 14 and 17-18. Preferably, a plurality of access apertures 48 are provided in each pocket 44. The apertures 48 may be spaced apart and may further be evenly spaced about the periphery of the sheet 23, although even spacing is not required. Any suitable size opening or depth thereof may be acceptable such that it provides access to the gripper bar 50 by a suitable mounting tool. That is, the access opening 48 may extend through the material forming one or both sides of the pocket 44, and may further extend through the material of the sheet 23. As a result, the bar or bars 50 are exposed at locations around the perimeter of the rear 52 of the billboard 24 or sheet 23.

As best seen in FIG. 7, the bulletin 22 described above is mounted to the billboard structure 24 such that it may be wrapped around the periphery or outer edge or surface 36 of the structure, and more specifically may be wrapped or folded over the top edge, the bottom edge, the left edge and the right edge of the billboard structure 24. The bulletin 22 is more specifically removably mounted to the billboard structure 24 such that the rear surface 38 of the bulletin 22 faces the front surface 54 of the billboard structure 24 and the perimeter of the bulletin 22 is folded over the outer edge 36 of the billboard structure 24 such that the strengthening strip 42 extends at least partially over the outer edge 36 and the pocket 44 is positioned at the rear surface 38 of the billboard structure 24. At the corners 56 of the wrapped bulletin 22 on the backside 52 of the billboard structure 24, as shown in FIG. 1, any suitable arrangement may be used. For example, the corners of the bulletin 22 may be folded, cut, or simply bunched. In addition to the pocket 44 and strengthening strip 42, a portion of the front or display surface 34 of the bulletin 22 may be visible on the back side of the assembly 20 (see FIGS. 1 and 6). Pockets 44 are spaced a distance inward from outer edge 36 toward the mid-line of the billboard structure 24. The folded portion 59 of the strengthening strip 42 which forms pocket 44 is positioned such that it faces billboard structure 24 (see FIG. 7). The strengthening strip 42 or reinforcing strip is provided in contact with the surface of the outer edge 36 of the billboard structure 24 and preferably positioned such that the strengthening strip 42 contacts the front surface 54 and rear surface 52 of the billboard structure 24 adjoining the outer edge 36. When mounted in position on the billboard structure 24, approximately six inches of each strengthening strip 42 may be preferably positioned on the front side 54 of the billboard structure 24 behind the display surface 34.

The bulletin 22, and in particular the pole pocket 44, receives a gripping bar or rod or pole 50 (as best seen in FIGS. 6-7). To this end, pole 50 engages the strengthening strip 42. The pole 50 may be any suitable size or length for the purposes provided, and may be further provided in segments. For example, two or more pole 50 segments can be provided in a pocket 44 along one side of the bulletin 22. The pole 50 is received within or carried by the pole pocket 44. The pole 50 may be formed of any suitable material. In a preferred embodiment, the pole 50 has a weight sufficient to at least partially tension the bulletin 22 and further includes a degree of rigidity to withstand a force placed upon it by a tensioning device 58.

One or more attachment assemblies 60 may be used to further secure the bulletin 22 to the billboard structure 24. In FIG. 1, a portion of two attachment assemblies 60 are shown for purposes of example, but any number of attachment assemblies may be provided without departing from the overall scope of the present invention. The access openings 48 or apertures in the pockets 44 provide access to the gripping bar or rod 50 by the assemblies 60. A strap or a narrow webbing material may be used as the attachment assembly 60 to secure the bulletin 22 to the structure. For example, a chain webbing may be used and secured on one end to the gripper bar 50 in the access opening 48 and can be tightened. To this end, the desired attachment assembly 60 may include an attachment device 62, such as for example, a hook, for engagement with the rod 50 in the pocket 44 through the access opening 48. A plurality of hooks 62 may be provided for engagement with the rod or gripper bar 50 in a plurality of access openings 48. The attachment assembly may further include a ratchet or tensioning device 58 which may be used in one or more examples to secure the pole in the pocket 44 to the billboard structure 24. For example, the webbing or strap may be attached at one end to the gripper bar 50 and at the other end to a ratchet 58. The ratchet may be further secured to a portion of the billboard structure 24. To this end, the ratchet or other tensioning device 58 may be provided with an attachment device 62 for attaching to the billboard structure 24, and preferably a solid structure, such as but not limited to a rod, a ladder or other structure carried by the billboard. Any number of tensioning devices 58 may be used to tension and secure the bulletin 22 to the billboard structure 24. In one or more examples, four to eight tensioning devices 58 may be used to secure or tension each side of the bulletin 22 or billboard, and more preferably, four to five tensioning devices 58 may be used on each short side of a rectangular shaped billboard and five to eight tensioning devices 58 may be used on each long side of a rectangular shaped billboard. Further, it is contemplated that the respective attachment mechanisms may attach to the bar in multiple locations or may attach to multiple bars and thus secure or tension one bar in relation to another bar.

A method of assembly of the billboard assembly 20 in one or more examples of embodiments having a bulletin 22 with a peripheral strengthening for use on a mounting structure 24 is also provided. In the method of assembly, the pocket 44 may be formed in an operation separate from the finishing of the bulletin 22, as shown in FIGS. 9-10 where a back surface 38 of a bulletin is shown with a strengthening strip 42 secured along one edge of the sheet 23. For ease of illustration, the size of the strengthening strip 42 has been exaggerated relative to the size of the sheet 23 in FIGS. 9-10. In one example, hot-air welding, welding, sewing, adhering or any other suitable means may be used to attach the pocket 44 into its preferred shape. In the illustrated embodiment, the pocket 44 is formed by folding the strip of strengthening material 42 or a portion thereof over and at least partially onto itself, so as to form a pocket extending along the strip, and attaching at least a portion, such as attachment portion 63, of the folded edge to a surface of the material so as to form an opening, namely the pocket, therein. In one or more examples of embodiments, attachment portion 63 may be attached along its entire length or along a portion thereof. The attachment portion 63 may be attached to any suitable width. The attachment portion 63 is preferably a width suitable to secure the folded portion in position, and may have a width up to the full width of the pocket 44. More preferably the width of attachment portion 63 is approximately one inch of the end of the strip 42 attached over onto itself to form the pocket 44. Further, any suitable size pocket 44 may be formed. In one example of an embodiment, the pole pocket 44 is approximately four inches wide.

The strip, or the pre-made pocket 44 or strengthening strip 42 having the pocket 44 thereon, may then be attached to one of the front surface 40 and the rear surface 38, by any suitable means such as by welding, hot-air welding, sewing or adhering, to at least a portion of the perimeter or outer periphery of the sheet 23. More specifically, the reinforcement or strengthening strip 42 having a pocket 44, and preferably a plurality of such strips, may be attached to the billboard substrate 23 on or around the perimeter of the bulletin 22. Any suitable width of the strip may be attached to the billboard substrate 23. In one example, a strip 42 having a twelve inch width is secured to the billboard substrate, for example along several longitudinal locations across the width of the strengthening strip 42 in the manner discussed above.

The bulletin 22 and sheet 23 are installed onto the billboard or mounting structure 24 by wrapping or folding the bulletin 22 over and around the outer surface 36 of the billboard structure 24. As part of this step, the strengthening strip 42 or strips mounted on the front or rear of the sheet 23 may contact the perimeter or periphery of the billboard structure 24, and the pocket 44 or plurality of pockets 44 are positioned at the backside of the billboard structure 24.

A pole or gripper bar 50 is then inserted into the insertion opening 46 in one or more pockets 44 and extended across a substantial portion of the length of the pocket 44. In one example, an insertion opening 46 may be cut within the pocket 44 prior to insertion of the gripper bar 50. In one preferred embodiment, a pocket 44 is provided along the entire outer edge 41 of the sheet 23, for example substantially along the entire length of each of such edges, and one or more gripper bars 50 is inserted into each of such four pockets 44 so that substantially the entire length of each pocket is occupied by one or more grippers bars. One or more access openings 48 may be provided in the pockets 44 so as to permit the gripper bar 50 to be inserted within the pocket 44. The openings may be formed by any suitable method, including but not limited to pre-forming, punching, or cutting in place with a knife or other cutting tool. At least one and preferably a plurality of attachment mechanisms or assemblies 60 are then utilized to secure the bulletin 22 to the mounting structure 24. More specifically, the attachment device or hook 62 of each attachment mechanism is attached to the respective bar 50 at one end and secured at its other end to a tensioning device 58 or ratchet. The ratchet is secured to an appropriate structure. Tension is then applied to the bar 50, distributing the load of the bar across the perimeter of the bulletin 22 and tightening the bulletin 22 to the billboard structure 24, providing a taut display surface 34 on the front of the billboard assembly 20.

As the bulletin 22 is tensioned on the mounting structure 24, the peripheral portion of the sheet 23 having the strengthening strip 42 mounted thereon is more durable than the remainder of the bulletin 22, that is the interior of the bulletin and sheet 23, so as to inhibit tearing or damage to the portion of the bulletin 22 and sheet 23 extending around the outer surface 36 of the billboard structure 24. In the embodiment where first or perimeter reinforcement portion 61 of the strengthening strip 42 is attached to the substrate along one or more longitudinally-extending portions, for example a first longitudinally-portion extending adjacent imaginary line 71 and a second longitudinally-extending portion in the vicinity or underlying attachment portion 63, but without a third longitudinally-extending portion adjacent first end 78 so that the part of first portion 61 between the second longitudinally-extending portion and first end 78 is not attached to the substrate 23 and is thus a flap that extends free of the substrate 23, the bulletin substrate 23 can be easily stretched around the outer surface 36 of the billboard structure so as to inhibit the formation of undesirable wrinkles on the display surface 34 of the bulletin 22. Such flap desirably strengthens the bulletin 22 in the vicinity of outer surface 36 of the billboard structure.

The bulletin 22 with peripheral strengthening strip can, after being mounted and then removed from a first billboard structure 24, be mounted to a second billboard structure 24. The strengthening strip provides the lightweight sheet 23 with sufficient durability around its perimeter so as to be stretched around the outer surface 36 and thus sequentially mounted to a plurality of billboard structures 24. In this manner, the life of the bulletin 22 can be extended.

Figure 11:
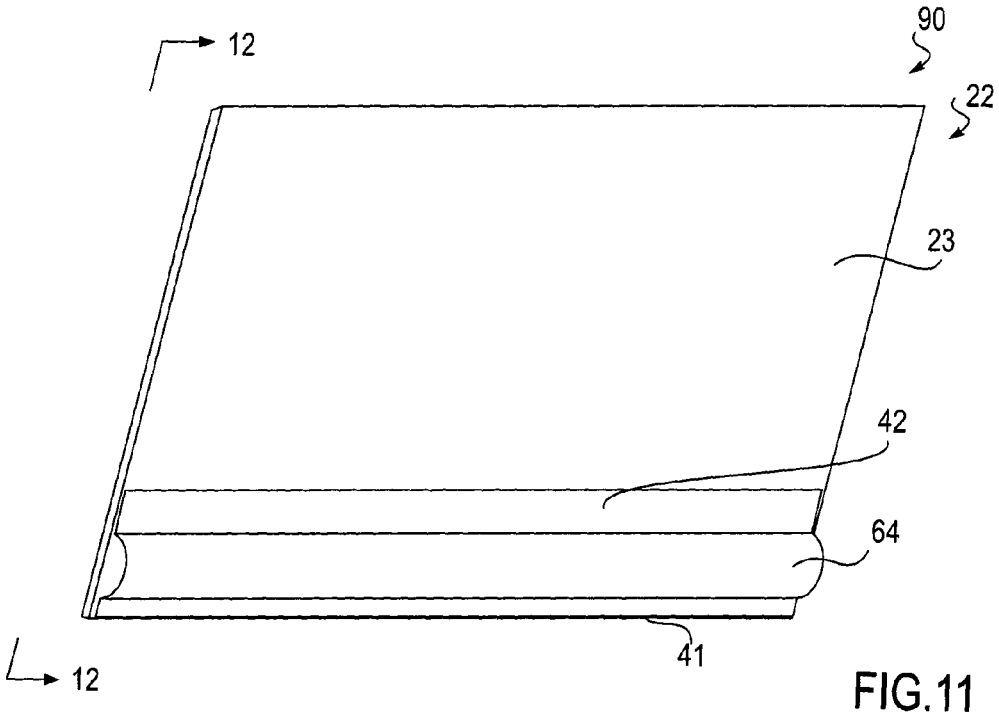
FIG. 11 is a perspective view of a portion of an alternative embodiment of a bulletin with peripheral strengthening strip of the present invention for use with the billboard assembly of FIG. 1, showing a peripheral strengthening strip along one edge of the rear surface.
Figure 12:
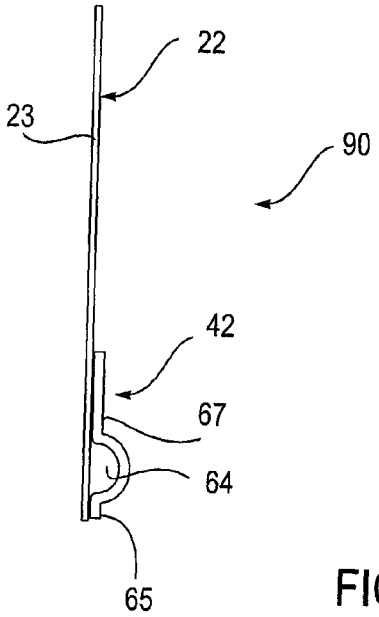
FIG. 12 is a side elevation view of the bulletin with peripheral strengthening strip of FIG. 11, taken along line 12-12 of FIG. 11.

In an alternative embodiment of a bulletin with strengthening strip of the present invention, shown in FIGS. 11-12, a billboard structure 24, bulletin 22, sheet 23 and strengthening strip 42 are provided that are substantially identical to that described and shown in FIGS. 1-10, and like reference numbers are used to designate like components, except that the pocket 64 may be formed at least partially from the strengthening strip 42. In FIGS. 11-12, sizes of the strengthening strip and pocket relative to the size of the sheet 23 are exaggerated for purposes of illustration and only a single strengthening strip is shown mounted on the sheet 23. In this regard, billboard assembly 90 of FIGS. 11-12 may include a bulletin 22 mountable to a mounting structure 24 (not shown) with the aide of a pole 50 (not shown) and a tensioning device 58 (not shown). In the same manner as discussed above, the bulletin sheet 23 may further include a strengthening strip 42 or a plurality of strengthening strips mounted along one or more outer edge portions or outer edge 41 of the sheet 23. A plurality of strengthening strips may also be provided along one side or one edge portion of the sheet. These strips 42 may extend along the longitudinal edge of the sheet or be proximate thereto. The strengthening strip 42 may be attached to the back or rear surface 38 or front surface 40 of the sheet 23 along a first longitudinal portion 65 and along a second longitudinal portion 67 so as to form the pocket 64 between the first and second longitudinal portions of the strip 42. As a result, a first wall of the pocket 64 is formed by the strengthening strip 42 and the second wall of the pocket 64 is formed by the sheet 23. The pocket 64 may be formed in any suitable manner such as described above, for example by attaching the strengthening strip 42 to the sheet 23 at the first longitudinal portion 65, folding or bending the strengthening strip 42 and attaching a portion of the folded edge or wall of the strip to the sheet 23 at the second longitudinal portion.

Figure 13:
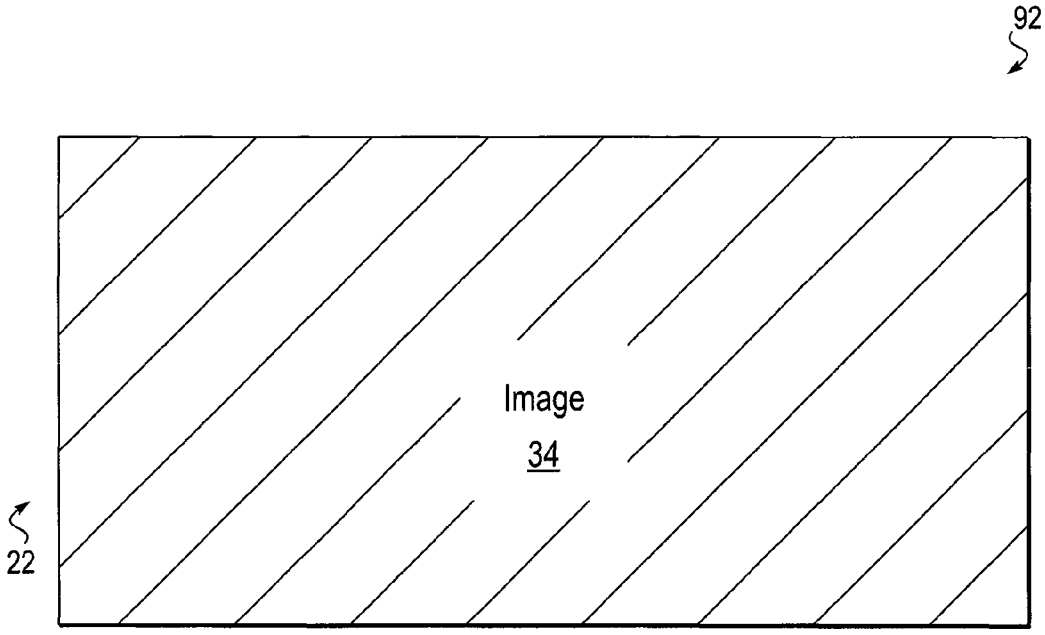
FIG. 13 is a front elevational view of another embodiment of a bulletin with peripheral strengthening strip of the present invention for use with the billboard assembly of FIG. 1.
Figure 14:
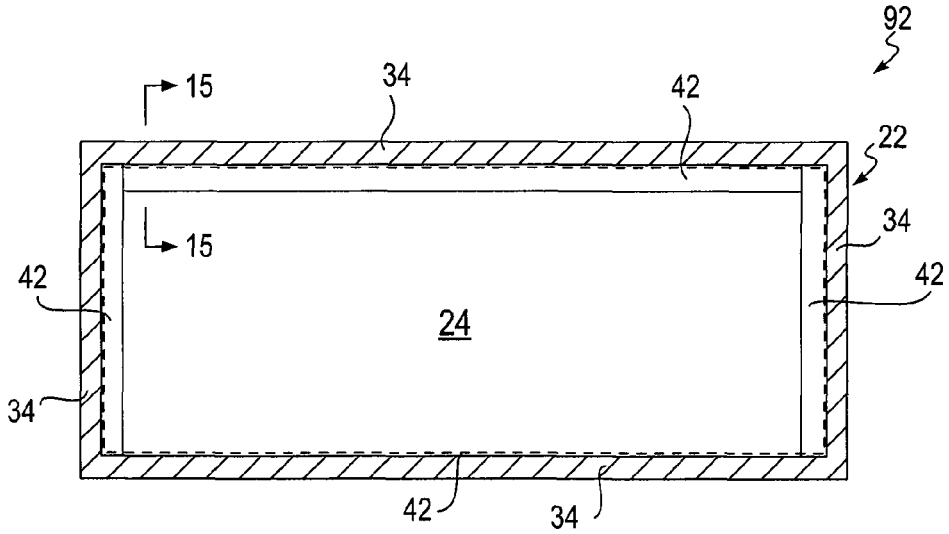
FIG. 14 is a rear elevational view of a billboard assembly having the bulletin of FIG. 13 mounted on a mounting structure of the billboard assembly of FIG. 1.
Figure 15:
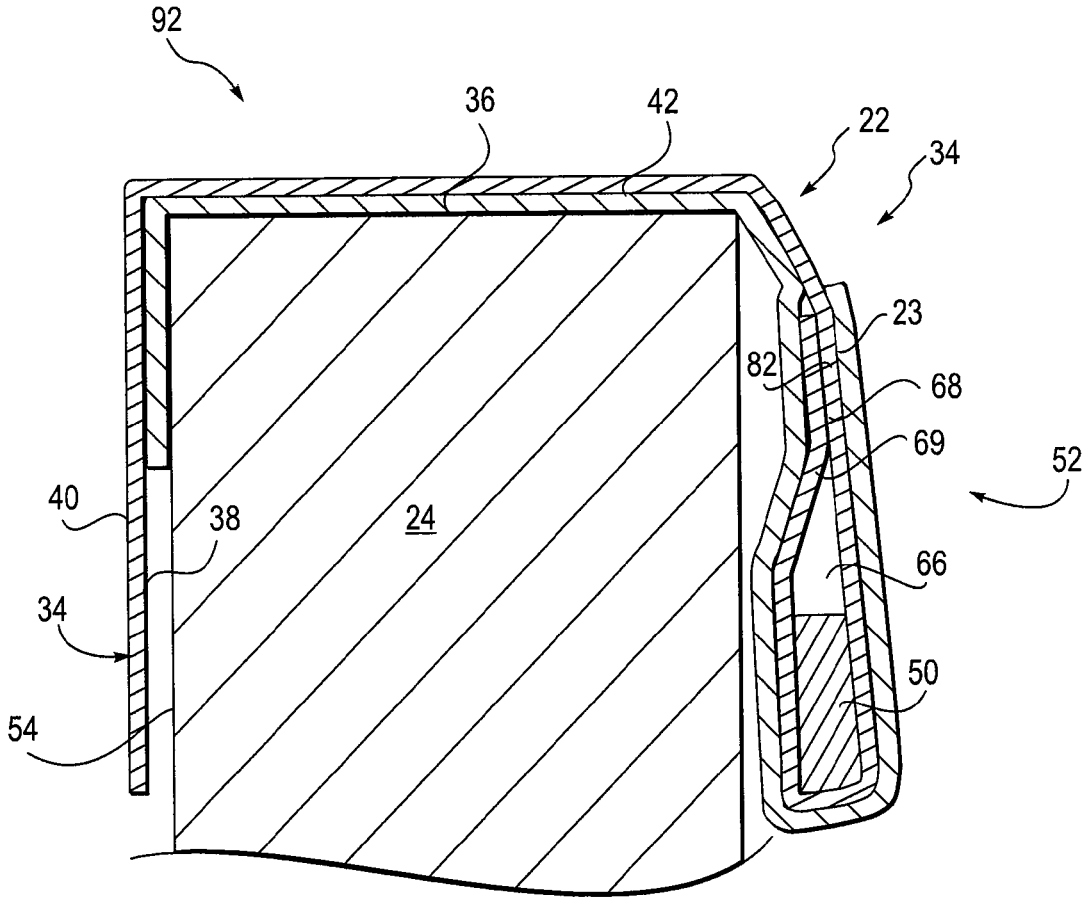
FIG. 15 is a cut away elevation view of the billboard assembly of FIG. 14, taken from line 15-15 of FIG. 14.

In a further alternative embodiment of a bulletin with peripheral strengthening strip of the present invention, shown in FIGS. 13-15, a pocket 66 may be formed in a conventional manner by the sheet 23. In this embodiment, the billboard structure 24, bulletin 22, sheet 23 and strengthening strip 42 are substantially identical to that described and shown in FIGS. 1-10 and like numbers are used to designate like components. The billboard assembly 92 may include a bulletin 22 mounted to a mounting structure 24 by means of a pole 50 and a tensioning device 58 (not shown). In billboard assembly 92, the pole pocket 66 is not pre-formed by the strengthening strip. Instead, the sheet 23 forms the pocket 66 by being folded upon itself such that a first longitudinal portion 68 of the rear surface 38 of the sheet 23 is placed in contact with second longitudinal portion 82 of the rear surface 38 of the sheet 23 to create the pocket 66. The strengthening strip 42 may be attached to the sheet 23 in any suitable manner, for example as discussed above. The strengthening strip 42 may extend around all or a portion of the pocket 66 formed by the sheet so as to provide support to at least one side of the pocket, and can also extend over the portion of the sheet in contact with the mounting structure 24. The illustrated strengthening strip 42 extends all the way or entirely around the pocket 66 (see FIG. 15). In one example, the strengthening strip 49 may be attached by any suitable means over the folded part 69 of the sheet 23 as well as attached to the remainder of the strengthening strip 42. In alternative embodiments, the strengthening strip 42 may extend around or cover only a portion of the pocket 66, such as a top, bottom or side portion of the pocket or some combination thereof. For example, the strengthening strip 42 can extend along the rear surface 38 of the sheet 23 and alongside the portion of the sheet forming the interior wall of pocket 66, that is the pocket wall adjacent the billboard structure 24 when the bulletin 22 is mounted to the billboard structure, but not extend along the portion of the front surface 40 of the sheet 23 forming the exterior wall of pocket 66, that is the wall facing away from the billboard structure 24 when the bulletin 22 is mounted to the billboard structure. The strengthening strip 42 may extend around the outer surface 36 and onto at least a portion of the face 54 of the billboard structure 24, as shown in FIG. 15, or around the outer surface 36 but not onto the face 54, or neither around the outer surface 36 or onto the face 54. A portion of the sheet 23 may be optionally cut prior to creation of the pocket to reduce overhang. For example, any suitable length, such as but not limited to four inches, may be removed from the sheet on the backside 52 of the assembly. The bulletin 22 may be mounted to the mounting structure 24 in any suitable manner, for example as described above with respect to the embodiment shown in FIGS. 1-10.

In use, a part of the display surface 34 or graphic or image printed on the first side or face 40 of the bulletin 22 in billboard assembly 92 is folded over the periphery or outer edge 36 of the billboard structure 24. As a result, the backside 52 of the billboard includes a portion of the display surface 34, as shown in FIG. 15. Alternatively, the display or graphic may not be printed to the perimeter of the bulletin 22, in which case the portion of the bulletin 22 which is folded over the periphery of the billboard structure 24 does not have a printed image thereon.

Figure 16:
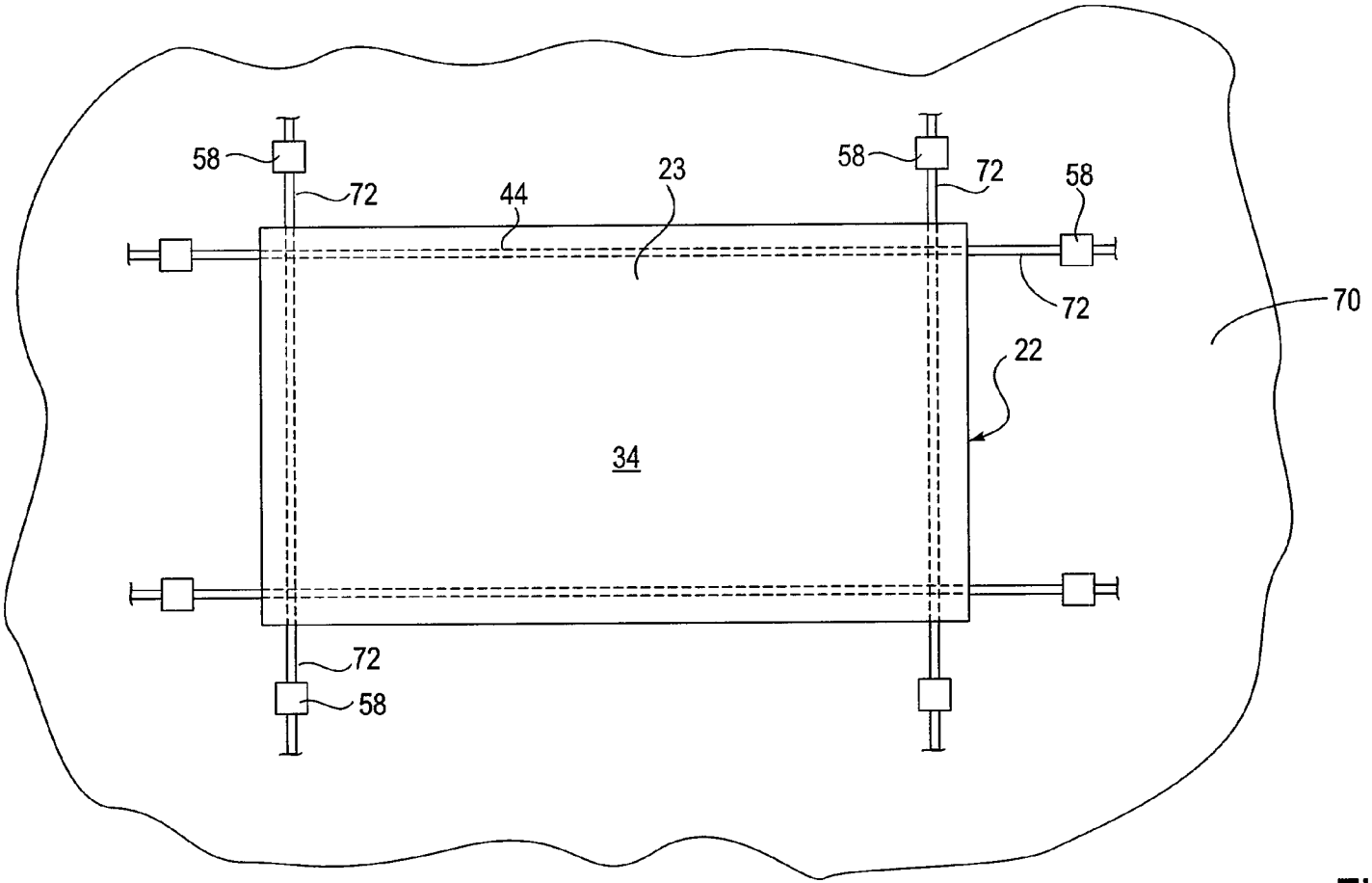
FIG. 16 is an elevational view of a further embodiment of a bulletin with peripheral strengthening strip of the present invention mounted to a wall.

In another alternative embodiment, the bulletin 22 as described herein may be attached to a flat surface larger than the width or length of the bulletin 22, such as for example, a wall 70 (see FIG. 16). In this embodiment, the bulletin 22 does not fold or wrap over a perimeter of a structure. Instead, the wall 70 may include a strap 72 or other tensioning device for engaging the bulletin 22. The strap 72 may include a device (not shown) for attachment to the gripper bar 50 by any suitable mechanism. Once the bulletin 22 is in position on the wall and the strap 72 attached to the bulletin, a tensioning device 58 or other suitable mechanism can be used to tension the bulletin 22 on the wall.

Figure 17:
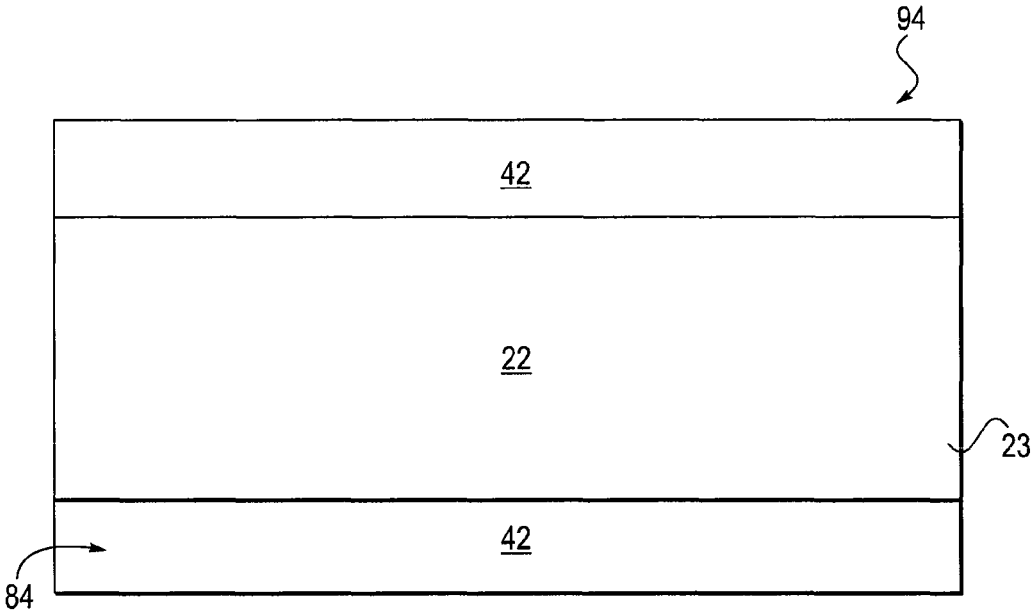
FIG. 17 is a rear elevational view of a portion of yet another bulletin with peripheral strengthening strip of the present invention in a partially assembled state, showing a peripheral strengthening strip along two edges of the bulletin.
Figure 18:
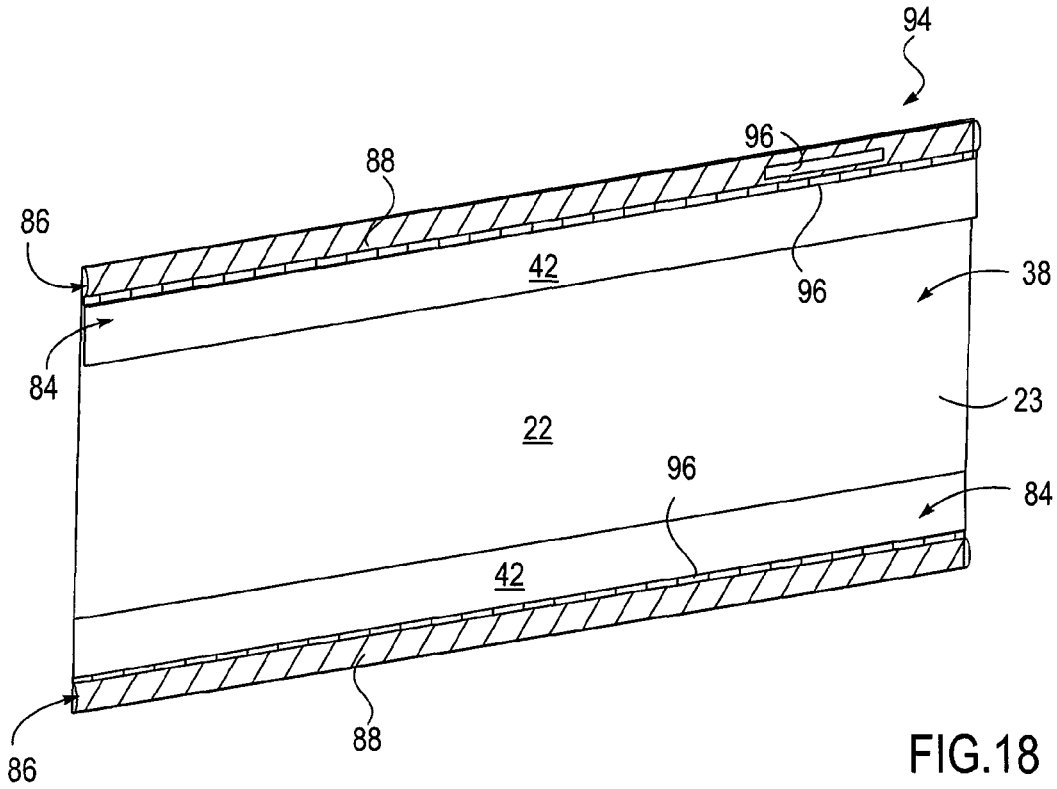
FIG. 18 is a rear perspective view of the portion of the bulletin shown in FIG. 17, in an assembled state with longitudinal edges folded to form a pocket.
Figure 19:
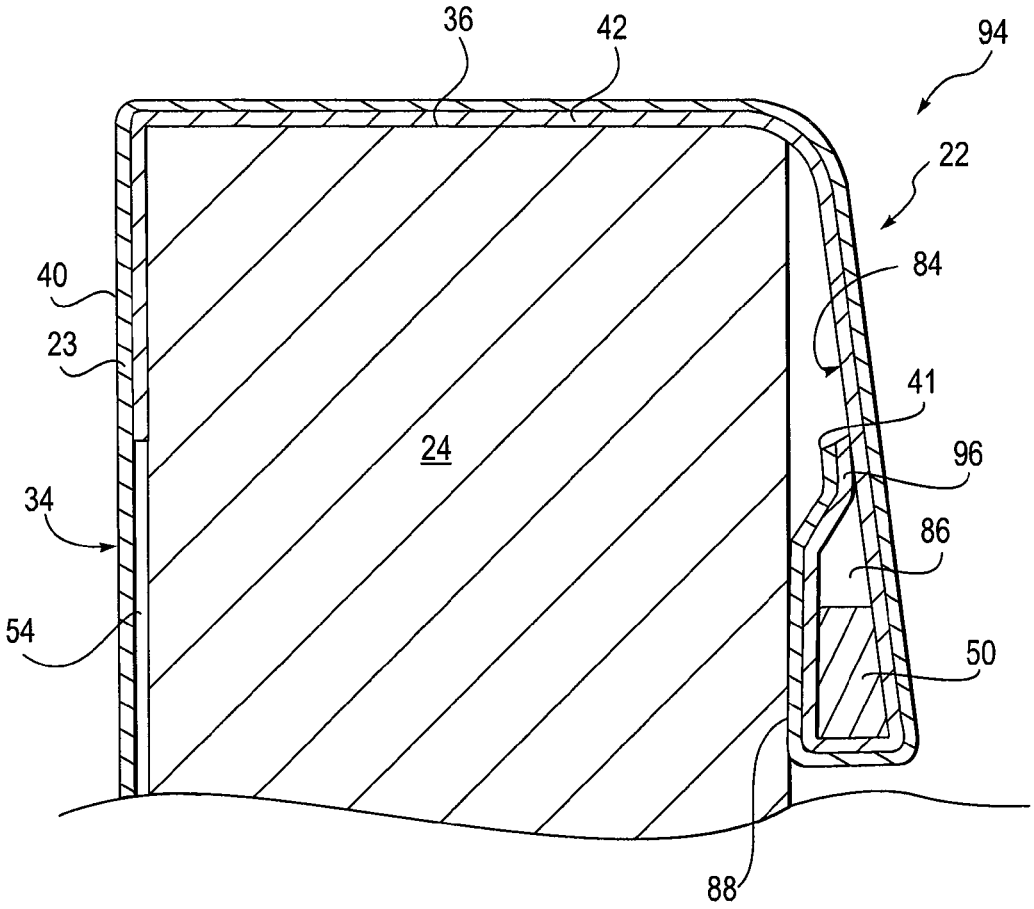
FIG. 19 is a cross-sectional view of the bulletin shown in FIG. 18 mounted on a mounting structure of the billboard assembly of FIG. 1.

A further alternative embodiment of a bulletin with peripheral strengthening is shown in FIGS. 17-19. Bulletin 22, sheet 23, mounting structure 24 and strengthening strip 42 are substantially identical in billboard assembly 94 to that shown and described in FIGS. 1-10 and like numerals have been used to identify like components. In billboard assembly 94, the strengthening strip 42 is adhered or otherwise attached along one or more longitudinal edges of sheet 23 adjacent the periphery or spaced therefrom. Although the strip 42 can be attached to the rear surface 38 or front surface of the sheet, FIG. 17 illustrates two strips adhered to the rear surface 38 along parallel and opposite edges of the sheet 23. The sheet 23 with attached strengthening strip 42 may be folded back on to a portion of the rear surface 84 of the strengthening strip 42 so that the pocket 86 is formed by the strengthening strip and the sheet 23 extends around the pocket 86 formed by the strengthening strip. The pocket may for instance extend across approximately one-third the width of the strengthening strip so as to allow for imprinting, represented for example by box or strip 96 in FIG. 18 for purposes of simplicity, along or on edge surface 88 at a location not intended for public view when the bulletin 22 is mounted on the structure 24. One end portion 96 of the strip 42 forms an attachment portion that attaches to the surface 84 of the strip 42. Attachment of the strip to itself or to the sheet may be accomplished by any suitable means, such as but not limited to welding, sewing or adhering. The length of the attachment portion 88 along the strip 42 may be any suitable length and is preferably sufficient to retain the pocket 86. The bulletin 22 with strengthening strip 42 may be mounted to mounting structure 24 in substantially the same manner as described above, and is partially illustrated in FIG. 19. The strengthening strip 42 may extend around the outer surface 36 and onto at least a portion of the face 54, as shown in FIG. 19, or around the outer surface 36 but not onto the face 54, or neither around the outer surface 36 or onto the face 54.

The bulletin with peripheral strengthening of the present invention, as well as the billboard assembly incorporating the same and the method of assembly, provide various advantages over currently available assemblies and bulletins. In this regard, the bulletin for use with the billboard structure may be formed of lightweight and recyclable materials, while retaining the strength necessary to prevent damage to the bulletin during installation and unusual wear and tear. Thus, a bulletin material is used which is of a lighter weight than traditionally used bulletin materials for similarly sized billboard assemblies, and may be more accurately matched to the weight necessary for the front surface area of the bulletin. The lighter weight bulletin material used in the current invention is also easier to dispose of than traditional bulletin materials used for billboard assemblies, is easier to recycle, and reduces waste when the bulletin must be replaced. The strengthening strip provides a second layer of material on the periphery or perimeter of the bulletin that is stretched over and around the periphery of the billboard, strengthening the bulletin where it contacts the front peripheral edge and rear peripheral edge of the billboard structure. The strengthening strip adds strength to an otherwise light-weight bulletin where the bulletin is stretched or pulled taut, and often slid, over the corner of a billboard structure. The material including the strengthening strip further reduces friction and thus glides more easily over the edges of the billboard structure, even when the structure includes sharp elements. The strengthening strip also allows the pocket for use in mounting the bulletin to the billboard structure to be created from a piece of material separate from the bulletin, allowing a strong material to be used only for the pocket and a less expensive material to be used for the bulletin. By attaching a pre-formed pocket to the bulletin, it is not necessary to fold and attach or form the edge of the larger bulletin during assembly. Furthermore, the pocket at least partially formed of the strengthening strip also provides added strength to the overall structure.

While the graphic of the present invention is illustrated in use on a billboard structure 24, it is appreciated that the graphic can be mounted on any other suitable billboard structure, support or mounting structure on which a printable material is to be placed, such as but not limited to the side of a building, a wall, a table top, a window, a bench or a the side or other portion of a truck, bus or other vehicle. In addition, the graphic of the present invention can used as a banner, temporary sign, flag, theater backdrop, tent or awning. In another embodiment of the graphic with peripheral strengthening strip of the present invention, a poster with peripheral strengthening strip can be provided for mounting on a front surface of a billboard structure by any suitable cabling system or other attachment means. Such a poster can be substantially identical to bulletin 22 in structure and have a strengthening strip like strip 42 attached to the sheet 23 of the poster in any suitable manner such as any of the manners disclosed above. The poster can be of any suitable size, and for example in one embodiment is approximately five (5) feet high by ten (10) feet wide and in another embodiment is approximately 125 inches high by 272 inches wide. The poster can include one or more pockets, such as pockets 44, for receiving one or more poles 50 for securing the poster to the billboard or other mounting structure. The strengthening strip can serve to strengthen the perimeter or outer periphery of the sheet 23 so that grommets or other components of the securing mechanism can be attached to the poster without tearing or otherwise damaging the sheet.

The foregoing has described a bulletin with peripheral strengthening, billboard assembly, and method of assembly. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

I claim:

1. A bulletin for use on a mounting structure having a face and a backside and a side surface extending between the face and the backside and having a width, comprising a sheet adapted to extend across the of the mounting structure, the sheet having a front surface for receiving an image and a rear surface and a peripheral portion that extends over the side surface when the sheet is being pulled taut on the mounting structure, a strengthening strip separate from the sheet secured to one of the front surface and the rear surface and extending along at least the peripheral portion and having a width greater than the width of the side surface of the mounting structure and being positioned on the peripheral portion of the sheet so as to strengthen the peripheral portion when the sheet is secured to the mounting structure and thus inhibit damage to the peripheral portion.

2. A bulletin for use with a pole and on a mounting structure having a face and a backside and an outer surface extending between the face and the backside and having a width, comprising a sheet adapted to extend across the face of the mounting structure and having a front surface for receiving an image and a rear surface and at least one edge, and a strengthening strip separate from the sheet secured to one of the front surface and the rear surface and extending along the at least one edge, the strengthening strip having a folded portion extending longitudinally along the strip for forming a pocket and having a remainder portion, the pocket adapted to receive the pole for securing the bulletin to the backside of the mounting structure and the remainder portion having a width greater than the width of the outer surface of the mounting structure for inhibiting damage to the sheet when extended over the outer surface during use.

3. The bulletin of claim 2, wherein the strengthening strip is provided with an aperture access the pocket and the pole in the pocket.

4. The bulletin of claim 2, wherein the sheet has a weight of less than four ounces per square yard.

5. The bulletin of claim 2, wherein the remainder portion is an unfolded portion.

6. The bulletin of claim 2, wherein the remainder portion is secured to the sheet.

7. The bulletin of claim 2, wherein the folded portion faces away from the one of the front surface and the rear surface.

8. The bulletin of claim 2, wherein the folded portion faces the one of the front surface and the rear surface.

9. A billboard assembly comprising a billboard structure having a face and a backside and an outer surface extending between the face and the backside and having a width, a sheet having a front surface and a rear surface and a portion for extending over the outer surface, at least one strengthening strip attached to one of the front surface and the rear surface and extending at least along the portion and having a width greater than the width of the outer surface, the sheet being removably mounted to the billboard structure such that the rear surface of the sheet faces the face of the billboard structure and the portion of the sheet is folded over the outer surface of the billboard structure such that the strengthening strip extends over the outer surface for inhibiting damage to the sheet.

10. The billboard assembly of claim 9, wherein the sheet is formed of a first material having a weight and the strengthening strip is formed of a second material having a weight greater than the weight of the first material.

11. The billboard assembly of claim 9, wherein the weight of the sheet is less than four oz/yd$^2$ and the weight of the strengthening strip is greater than one oz/yd$^2$.

12. The billboard assembly of claim 9, wherein the sheet has a first edge, a second edge, a third edge and a fourth edge, wherein the strengthening strip is a first strengthening strip attached to the portion of one of the front surface and the rear surface at the first edge, and further comprising a second strengthening strip attached to the portion of one of the front surface and the rear surface at the second edge, a third strengthening strip attached to the portion of one of the front surface and the rear surface at the third edge and a fourth strengthening strip attached to the portion of one of the front surface and the rear surface at the fourth edge.

13. The billboard assembly of claim 9 wherein the at least one strengthening strip at least partially forms a pocket extending longitudinally along the portion and positioned on the backside of the billboard structure, a pole received in the pocket for tensioning the sheet on the backside of the billboard structure so that the sheet is taut on the face of the billboard structure.

14. The billboard assembly of claim 13, further comprising a tensioning device for securing the pole in the pocket to the billboard structure.

15. The billboard assembly of claim 13, wherein the strengthening strip is provided with an aperture to access the pocket and the pole in the pocket.

16. A method of forming a lightweight bulletin for attachment to a mounting structure with a pole, comprising providing a lightweight sheet having a perimeter and a display surface and a rear surface, providing a strip separate from the sheet, folding a portion of the strip over onto itself so as to form a pocket from the strip, attaching the strip to one of the display surface and the rear surface of the sheet along at least a portion of a perimeter of the sheet wherein the strip receives the pole when attaching the lightweight sheet to the mounting structure.

17. The method of claim 16, wherein the sheet is formed from a first material having a weight and the strip is formed from a second material having a weight greater than the weight of the first material.

18. The method of claim 16, wherein the weight of the sheet is less than four oz/yd$^2$ and the weight of the strip is greater than one oz/yd$^2$.

19. The method of claim 16, wherein the first material has a first edge, a second edge, a third edge and a fourth edge, and wherein the second material is a first strengthening strip attached to the perimeter of one of the front surface and the rear surface at the first edge, and further comprising attaching a second strengthening strip to the perimeter of one of the front surface and the rear surface at the second edge, attaching a third strengthening strip to the perimeter of one of the front surface and the rear surface at the third edge and attaching a fourth strengthening strip to the perimeter of one of the front surface and the rear surface at the fourth edge.

20. A method of mounting a bulletin on a billboard structure having a face and a backside and an outer surface extending between the face and the backside, comprising providing a bulletin including a sheet having a display surface and a rear surface and a portion for extending over the outer surface and a strip attached to one of the display surface and the rear surface of the sheet along at least the portion of the sheet so that it pocket is formed with at least one of the sheet and the strengthening strip, removably mounting the bulletin to the mounting structure by folding the portion of the sheet around the outer surface of the mounting structure so that the strip extends entirely over the outer surface for inhibiting damage to the portion of the sheet and the pocket is located at the backside of the mounting structure.

21. The method of claim 20, further comprising tensioning the sheet on the mounting structure by inserting a pole into the pocket, attaching a tensioning device to the pole and operating the tensioning device to pull the bulletin taut.

* * * * *